US005840164A

United States Patent [19]

Staerzl

[11] Patent Number: 5,840,164

[45] Date of Patent: Nov. 24, 1998

[54] GALVANIC ISOLATOR

[75] Inventor: Richard E. Staerzl, Fond du Lac, Wis.

[73] Assignee: Brunswick Corporation, Lake Forest, Ill.

[21] Appl. No.: 747,259

[22] Filed: Nov. 12, 1996

[51] Int. Cl.[6] ..... C23F 13/00

[52] U.S. Cl. ..... 204/196; 114/270; 204/197; 205/724; 205/740; 307/95

[58] Field of Search ..... 204/196, 197; 205/724–729, 740; 307/95; 114/270

[56] References Cited

U.S. PATENT DOCUMENTS

| | | | |
|---|---|---|---|
| 3,132,081 | 5/1964 | Sutton | 204/196 |
| 3,169,105 | 2/1965 | Preiser et al. | 204/196 |
| 3,208,925 | 9/1965 | Hutchison et al. | 204/196 |
| 3,362,900 | 1/1968 | Sabins | 204/196 |
| 3,636,409 | 1/1972 | Stephens et al. | 204/196 |
| 3,769,926 | 11/1973 | Race | 204/196 |
| 3,853,730 | 12/1974 | Anderson . | |
| 3,953,742 | 4/1976 | Anderson et al. . | |
| 4,117,345 | 9/1978 | Balcom | 204/196 |
| 4,322,633 | 3/1982 | Staerzl . | |
| 4,492,877 | 1/1985 | Staerzl . | |
| 4,528,460 | 7/1985 | Staerzl . | |
| 4,872,860 | 10/1989 | Meisenburg . | |

OTHER PUBLICATIONS

"Everything You Need to Know About Propellers", pp. 51–52, 4th Ed. Brunswick Corp., P/N 90–861244–92. date unavailable.

*Primary Examiner*—T. Tung
*Attorney, Agent, or Firm*—Andrus, Sceales, Starke & Sawall

[57] ABSTRACT

A galvanic isolator to protect against galvanic corrosion of a submersible metal marine drive. The galvanic isolator is positioned between shore ground and boat ground to prevent the flow of destructive galvanic currents between the shore ground and the boat ground, while maintaining the safety function of neutral ground. The galvanic isolator of the invention includes a blocking element positioned between the boat ground and the shore ground that can be switched between an open and a closed state by a trigger circuit. The trigger circuit closes the blocking element when the voltage difference between the boat ground and the shore ground exceeds a threshold value, such as 1.4 volts. During operation of the galvanic isolator during the high fault current situation, power is dissipated only by the blocking element, rather than by the combination of the blocking element and the trigger device. In this manner, the galvanic isolator reduces the amount of power dissipated during high current conditions and therefore reduces the amount of heat generated by the galvanic isolator.

21 Claims, 1 Drawing Sheet

GALVANIC ISOLATOR

BACKGROUND OF THE INVENTION

The invention relates to a galvanic isolator for submersible marine drives. The galvanic isolator is placed between boat ground and shore ground to prevent corrosion of a submersible metal marine drive. More particularly, the invention is a galvanic isolator that reduces the amount of power dissipated by the isolator when high fault currents flow between the boat ground and shore ground.

The leading cause of corrosion damage in a marine propulsion system is galvanic corrosion (i.e., electrochemical interaction between dissimilar metals) . Galvanic corrosion is most prevalent when the marine drives, both outboard motor and stern drives, are immersed in salt water, brackish water, or other waters having high conductivity caused by pollution. In the process, one of the dissimilar metals is eaten away. Often it is the aluminum housing of the lower unit that suffers from corrosive deterioration. This damaging corrosion can be eliminated by providing a sacrificial metal anode—such as zinc or aluminum-which will preferentially corrode to protect the lower unit, or by installing a direct current corrosion prevention system on the boat, such as a Quicksilver MerCathode® system. Direct current protection systems impart a DC current on a permanent anode mounted to the transom wall below the water level to create a protective polarization for the lower unit (the cathode) to retard such corrosive action. The DC power source must have the positive side coupled to the anode and the negative side coupled to the metal lower unit to be protected from corrosion. By maintaining the anode at an appropriate potential, a small DC current is supplied to the lower unit to maintain a protective polarization thereon and essentially prevent galvanic corrosion.

While sacrificial anodes and DC current protection systems are normally effective to prevent corrosion of the lower unit, these systems can be inadequate to prevent galvanic corrosion when a boat is plugged into shore power. When a docked boat is plugged into a source of shore power, destructive galvanic corrosion currents can flow from the lower unit of the marine drive through the boat ground to the shore ground, thus exacerbating galvanic corrosion. To solve this problem, a galvanic isolator can be installed between the shore ground and boat ground to block the passage of galvanic DC currents, while still providing a path to ground for dangerous AC fault currents.

FIG. 1 shows is a prior art galvanic isolator 10 that includes two pairs of diodes, one pair of the diodes 16,18 biased in the forward direction between boat ground and shore ground and one pair 20,22 biased in the reverse direction. Also connected in parallel with each pair of diodes is a capacitor 24. In the configuration shown in FIG. 1, the diodes prevent the passage of galvanic DC current between boat ground 12 and shore ground until the forward or reverse voltage between the boat ground 12 and shore ground reaches approximately 1.4 volts, which is the sum of the voltage drop across the diode pair required to turn on each pair of diodes. Typically, the galvanic voltage difference between the dissimilar metals is approximately 1 volt DC, so the galvanic isolator 10 shown in FIG. 1 effectively prevents corrosion while still providing a path to ground for dangerous fault (shock) currents.

Although the galvanic isolator 10 configuration shown in FIG. 1 effectively prevents galvanic corrosion, the diodes dissipate the current passing therethrough as heat. It is desirable that the galvanic isolator 10 operate at 130% over current for approximately 2 hours without creating excessive heat so that the housing of the isolator 10 does not exceed 90° F. A housing having larger heat exchange fins could be used. However, the size of the housing is limited by the space requirements of the boat. It is therefore desirable to reduce the amount of heat generated by the isolator 10 especially when dissipating relatively high currents in order to meet the ever increasing industry standards.

BRIEF SUMMARY OF THE INVENTION

The invention is a galvanic isolator that prevents the flow of galvanic current between shore ground and boat ground when a boat is plugged into shore power, and reduces the amount of heat generated by the isolator when a fault occurs and it is necessary to flow fault current through the isolator for a substantial period of time.

The galvanic isolator comprises at least one blocking element electronically connected between the boat ground and the shore ground. The blocking element is preferably an SCR that is operable between an opened and a closed state. In the opened positioned, the blocking element prevents current from flowing through the blocking element between boat ground and shore ground. In the closed position, the blocking element allows current to flow through the blocking element, thus creating a direct current flow path between the boat ground and the shore ground.

A trigger circuit is electronically connected to the blocking element to control the closing of the blocking element. The trigger circuit preferably includes a current limiting resistor and a diode that closes the blocking element when the voltage difference between the boat ground and the shore ground exceeds approximately 1.4 volts.

The typical galvanic voltage present between the dissimilar metals in marine applications is approximately 1.0 volts (i.e. potential difference between aluminum and steel). The trigger element thus maintains the blocking element in the open position when a fault current is not present, thereby blocking destructive galvanic current flow. When a fault is present, the blocking element is closed and current flows through the blocking element and not through the trigger circuit. Since current flows through a single SCR in a fault condition, rather than two diodes in series as in the prior art, the amount of heat generated by the isolator is effectively halved in comparison to prior art devices.

In another feature of the invention, the galvanic isolator can include a bypass relay which provides a direct current path between boat ground and shore ground when fault current through the galvanic isolator exceeds a threshold amount, such as 30 A. This feature further limits the amount of heat generated by the isolator under fault conditions by capping the maximum amount of current flowing therethrough.

In another feature of the invention, a temperature switch can also be provided in the galvanic isolator. The temperature switch can be installed in line between boat ground and shore ground. The temperature switch closes to provide a direct current path between boat ground and shore ground should the temperature of the galvanic isolator exceed a predetermined value, such as 70° C.

Various other features, objects, and advantages of the invention will be made apparent from the following detailed description and the drawings.

BRIEF DESCRIPTION OF THE SEVERAL VIEWS OF THE DRAWING

The accompanying drawings illustrate the best mode presently contemplated by the inventor for carrying out the invention.

In the drawings.

DETAILED DESCRIPTION OF THE INVENTION

Prior Art

Figure 1:
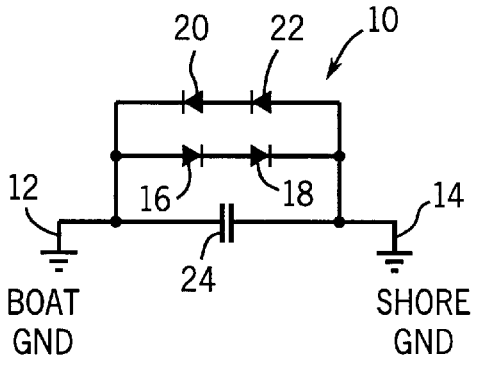
FIG. 1 PRIOR ART
FIG. 1 is a schematic circuit diagram of a prior art galvanic isolator.

Referring first to FIG. 1, a prior art galvanic isolator 10, as previously discussed, is thereshown. The galvanic isolator 10 is particularly useful when the boat on which it is mounted is docked at shore and connected to a source of shore power. The galvanic isolator 10 is placed in series between the boat ground 12 and the shore ground 14. The galvanic isolator 10 blocks destructive corrosion currents that are caused by the presence of dissimilar metals in the water. For example, the shore ground 14 could be connected to a steel dock or similar structure, while the boat ground 12 is typically connected to the aluminum housing of the submerged marine propulsion unit.

The prior art galvanic isolator 10 consists of a pair of forward biased diodes 16, 18 and a pair of reverse biased diodes 20 and 22. The diode pairs are connected in parallel between the boat ground 12 and the shore ground 14. As is well known, each of the diodes 16, 18, 20 and 22 has a voltage drop of approximately 0.7 volts and requires a voltage difference of approximately 0.7 volts between the anode and cathode to allow current to flow through the diode. Therefore, each pair of diodes shown in FIG. 1 blocks galvanic corrosion currents from flowing therethrough until there is approximately a 1.4 voltage difference between the boat ground 12 and the shore ground 14. Since the typical galvanic voltage is in the approximate range of 1.0 volts, the galvanic isolator 10 shown in FIG. 1 is effective in blocking the destructive galvanic current.

Capacitor 24, shown connected in parallel between boat ground 12 and shore ground 14, eliminates AC fault current from passing between the shore ground 14 and the boat ground 12, for example when a leakage or fault current is present due to a failure in the system. Without the capacitor 24, the AC fault current would combined with the galvanic DC current. The combined galvanic DC current and fault AC current could exceed the 1.4 volts needed to pass through the pair of diodes at least during part of the AC cycle. Hence a portion of the combined current could pass through the pair of diodes shown in FIG. 1, and potentially exacerbate galvanic corrosion. By using the capacitor 24, the AC fault current flows through the capacitor 24 which has a relatively low resistance, for example on the order of 0.1Ω. Therefore, only during very heavy fault currents would a high enough voltage be developed to permit forward biasing of the diodes and allow current to pass through the galvanic isolator 10.

While the prior art circuit shown in FIG. 1 is effective for isolating the lower gearcase of a marine propulsion unit from galvanic corrosion, a drawback of the system 10 is the relatively high amount of power generated by the diodes during a high fault current. In particular, heat is generated when current is passing through either of the pairs of diodes 16,18 and 20,22, and heat is generated or the current passes through each diode 16 and 18 or 20 and 22 of the pair.

Present Invention

Figure 2:
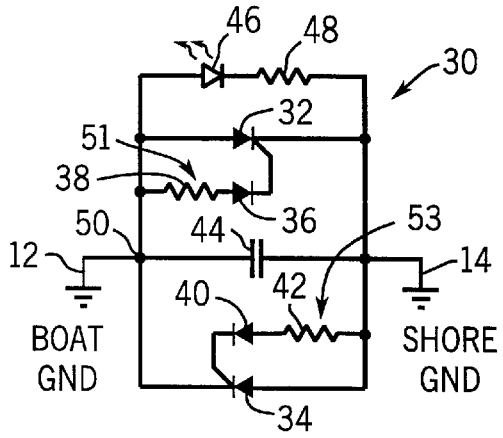
FIG. 2 is a schematic circuit diagram of a first embodiment of a galvanic isolator according to the invention.

FIG. 2 shows is a first embodiment of a galvanic isolator in accordance with the invention, generally referred to by reference numeral 30. In a manner similar to the prior art galvanic isolator 10 shown in FIG. 1, the galvanic isolator 30 is connected between boat ground 12 and shore ground 14. However, the galvanic isolator 30 generates less heat in the presence of a fault current than the prior art system 10.

The galvanic isolator 30 includes a forward biased SCR 32 and a reverse biased SCR 34. Each of the SCR's 32 and 34 are connected in parallel between the boat ground 12 and the shore ground 14. The gate of SCR 32 is connected to the cathode of diode 36. The anode of diode 36 is connected to the boat ground 12 through a current limiting resistor 38. The resistor 38 and the diode 36 form a trigger circuit 51 for SCR 32. Likewise, the cathode of diode 40 is connected to the gate of SCR 34, while the anode of diode 40 is connected to shore ground 14 through a similar current limiting resistor 42. The resistor 42 and the diode 40 form a trigger circuit 53 for SCR 34. In a similar manner to the galvanic isolator 10 previously described, a capacitor 44 is connected between the boat ground 12 and the shore ground 14. Also connected between the boat ground 12 and the shore ground 14 is an LED 46 and an LED current limiting resistor 48.

The operation of the galvanic isolator 30 of the first embodiment of the invention will now be described. A galvanic voltage can develop between the dissimilar metals electrically connected to the boat ground 12 and the shore ground 14, respectively. If the dissimilar metals are steel and aluminum, this galvanic voltage is approximately 1.0 volts. To facilitate understanding, assume that the galvanic voltage is a positive 1 volt between the boat ground 12 and the shore ground 14, although a voltage having a reverse polarity could also be present. With approximately 1 volt present at node 50, current flows through the trigger circuit 51 comprised of resistor 38 and diode 36. Since diode 36 has a 0.7 volt drop across its anode to cathode, a voltage greater than the 0.7 volts must be present at node 50 before diode 36 allows current to flow therethrough.

After the voltage at node 50 exceeds 0.7 volts, the diode 36 will not turn on the SCR 32 until there is approximately 0.7 volts supplied to the gate of the SCR 32. Therefore, 1.4 volts must be present at node 50 before SCR 32 is turned on. Once SCR 32 is turned on, current flows through the SCR 32 between the boat ground 12 and shore ground 14. The total power dissipated by the galvanic isolator 30 is the product of current flowing through the SCR 32 multiplied by the voltage drop of about 0.7 volt across the SCR 32. Therefore, during circumstances in which high fault current values are present, the heat generated by the galvanic isolator 30 is essentially limited to heat generated by current flowing through the single SCR 32. By using the galvanic isolator shown in FIG. 2, the amount of heat generated is effectively halved in comparison to the prior art galvanic isolator 10 shown in FIG. 1. When current is flowing between boat ground 12 and shore ground 14, current flows through LED 46 and current limiting resistor 48 to visually indicate that a fault current is present.

If a fault current of opposite polarity exists between the shore ground 14 and the boat ground 12, the second trigger device 53, consisting of resistor 42 and diode 40, will trigger SCR 34 in a similar manner as previously described with respect to SCR 32.

Figure 3:
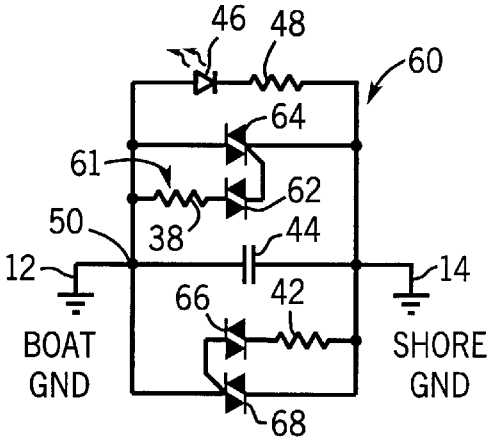
FIG. 3 is a schematic circuit diagram of a second embodiment of a galvanic isolator according to the invention.

FIG. 3 shows a third embodiment of a galvanic isolator 60 in accordance with the invention. The operation of the galvanic isolator 60 is similar in many respects to the galvanic isolator 30 shown in FIG. 2. However, the trigger circuit 61 of galvanic isolator 60 includes a diac 62, which in turn is connected to the gate of triac 64. The diac 62 and the triac 64 are bidirectional devices, but perform similar functions to the diode 36 and SCR 32 shown in FIG. 2. Since both the diac 62 and the triac 64 are bidirectional devices, the single diac 62/triac 64 combination obviates the need for the dual circuitry shown in FIG. 2.

When a voltage below approximately 1.4 volts is present at node 50, the combination of the diac 62 and the triac 64 prevents current from flowing between the boat ground 12 and the shore ground 14. When the voltage at node 50 increases above approximately 1.4 volts, the diac 62 triggers the triac 64, and allows current to flow through the triac 64. The power dissipated by the galvanic isolator 60 during high fault current is a product of the fault current and the voltage drop across the triac 64, which is approximately 0.7 volts. Therefore, the amount of power dissipated in the galvanic isolator 60 is again approximately half of that dissipated by the prior art galvanic isolator 10 shown in FIG. 1.

Included in the circuitry of the galvanic isolator 60 is a backup circuit consisting of resistor 42, diac 66 and triac 68. Although the first trigger circuit 61 and blocking device, consisting of resistor 38, diac 62 and triac 64, is a bidirectional configuration, the second combination of resistor 42, diac 66 and triac 68 is connected between the boat ground 12 and the shore ground 14 in order to provide additional safety protection should the triac 64 misfire or be a faulty component. As with the first embodiment shown in FIG. 2, the galvanic isolator 60 also includes capacitor 44, LED 46 and resistor 48 connected between shore ground 14 and boat ground 12 for the identical reasons previously discussed.

Figure 4:
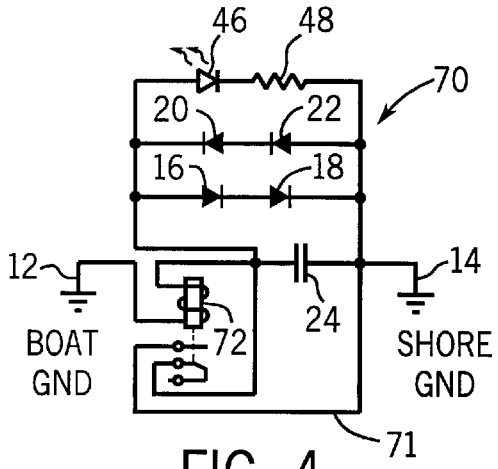
FIG. 4 is a schematic circuit diagram of a third embodiment of a galvanic isolator according to the invention.

FIG. 4 shows a third embodiment of the galvanic isolator according to the invention, generally referred by reference numeral 70. The galvanic isolator 70 shown in FIG. 4 contains similar current blocking elements as prior art galvanic isolator 10, consisting of diodes 16, 18, 20, and 22. However, the galvanic isolator 70 further includes a bypass element including line 71 between boat ground 12 and shore ground 14 with a relay 72 therein. The relay 72 provides a direct current path between boat ground 12 and shore ground 14 when the value of current in the system exceeds a threshold value. For instance, in the preferred embodiment of the invention, the relay 72 is actuated when the current flowing between the boat ground 12 and the shore ground 14 exceeds approximately 30 amps. During current flow above 30 amps, the relay 72 closes and provides a bypass for current that would normally flow through the series of diodes. In this manner, the amount of power dissipated by the diodes 16,18,20,22 is limited based upon a maximum value of 30 amps flowing through the diodes.

Figure 5:
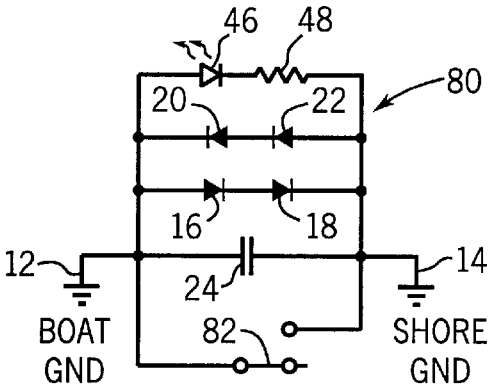
FIG. 5 is a schematic circuit diagram of a fourth embodiment of a galvanic isolator according to the invention.

FIG. 5 shows a fourth embodiment of the galvanic isolator according to the invention, generally referred to by reference numeral 80. In this embodiment, many components are similar to those present in the system 10 and 70 shown in both FIGS. 1 and 4. However, the galvanic isolator in FIG. 5 has a temperature switch 82 connected between the boat ground 12 and the shore ground 14. The temperature switch 82 is normally open, which allows the galvanic isolator 80 to function similarly to the galvanic isolator 10 shown in FIG. 1. The temperature switch 82 closes in response to high isolator temperature. Once the temperature of the isolator 80 reaches the threshold value, the temperature switch 82 closes to provide a direct current bypass between the boat ground 12 and the shore ground 14. It is preferred that the temperature switch 82 close when the temperature of the galvanic isolator 80 exceeds a temperature of approximately 70° C. The temperature switch 82 thus provided a maximum limit for heat generation by the galvanic isolator 80.

Although the galvanic isolating systems 30,60,70 and 80 have been discussed separately with respect to FIGS. 2–5, it may be desirable to combine various aspects of the circuitry shown in FIGS. 2–5 into a single galvanic isolating system to utilize the benefits of each system.

It is thought that the present invention and its advantages will be understood from the foregoing description, the form of the invention described above being merely preferred or exemplary embodiment of the invention. It may be apparent that various changes can be made without departing from the spirit and scope of the invention and sacrificing all of its material advantages.

I claim:

1. A galvanic isolator for protecting a submersible metal marine propulsion unit from corrosion, the galvanic isolator comprising:

a first element comprising a blocking element electrically connected between a boat ground and a shore ground, the blocking element being operable between an open state and a closed state and preventing the flow of current between shore ground and boat ground in the open state and allowing the flow of current between shore ground and boat ground in the closed state; and a second element comprising a trigger element electrically connected to the blocking element to selectively close the blocking element when the voltage difference between the shore ground and the boat ground exceeds a threshold value, said trigger element responding to said voltage difference between the shore ground and the boat ground without an active circuit powered by an external power supply.

2. The galvanic isolator of claim 1 wherein the blocking element is an SCR and the trigger element includes a current limiting resistor and a diode.

3. The galvanic isolator of claim 1 further comprising a capacitor connected between shore ground and boat ground in parallel with the blocking element.

4. The galvanic isolator of claim 1 further comprising a visual indicator and a resistor connected between shore ground and boat ground in parallel with the blocking element.

5. The galvanic isolator of claim 1 wherein a first blocking element and the first trigger element are biased to allow current to flow only from the boat ground to the shore ground, and a second blocking element and a second trigger element are biased to allow current to flow only from shore ground to boat ground.

6. The galvanic isolator of claim 1 wherein the first blocking element is an SCR and the first trigger element includes a current limiting resistor and a diode, and the second blocking element is an SCR and the second trigger element includes a current limiting resistor and a diode.

7. The galvanic isolator of claim 5 wherein the first and second blocking elements are SCRs.

8. The galvanic isolator of claim 5 wherein the first and second trigger elements are diodes.

9. The galvanic isolator of claim 1 wherein the blocking element is a triac and the trigger element is a diac.

10. A galvanic isolator for protecting a submersible metal marine propulsion unit from corrosion, the galvanic isolator comprising:

a first element comprising a first blocking element electrically connected between a shore ground and a boat ground, the first blocking element allowing current to flow only from boat ground to shore ground and preventing current from flowing from shore ground to boat ground;

a second element comprising a second blocking element electrically connected in parallel to the first blocking element, the second blocking element allowing current to flow from shore ground to boat ground and preventing current from flowing from boat ground to shore ground;

a third element comprising a bypass element connected between shore ground and boat ground, the bypass element including a switch that provides a direct path between shore ground and boat ground when the switch is closed said bypass element responding to the voltage difference between the shore ground and the boat ground without an active circuit powered by an external power supply.

11. The galvanic isolator of claim 10 wherein the switch of bypass element is closed by a current relay that is actuated to close the switch when the current passing between shore ground and boat ground exceeding a set value.

12. The galvanic isolator of claim 10 wherein the switch of the bypass element is a temperature switch that closes to provide a direct path between shore ground and boat ground when the temperature of the galvanic isolator exceeds a set temperature.

13. A galvanic isolator for protecting a submersible metal marine propulsion unit from corrosion, the galvanic isolator comprising:

first means comprising current blocking means for preventing the flow of current between shore ground and boat ground in the open state and for allowing the flow of current between shore ground and boat ground in the closed state, the current blocking means being operable between an open state and a closed state and electrically connected between a boat ground and a shore ground; and second means comprising means for triggering the closing of the current blocking means when the voltage difference between the shore ground and the boat ground exceeds a threshold value, the triggering means being electrically connected to the blocking means, said triggering means responding to said voltage difference between the shore ground and the boat ground without an active circuit powered by an external power supply.

14. The galvanic isolator of claim 13 further comprising a capacitor connected between shore ground and boat ground in parallel with the current blocking means.

15. The galvanic isolator of claim 13 wherein a first blocking means and a first trigger means are biased to allow current to flow only from the boat ground to the shore ground, and a second blocking means and a second trigger means are biased to allow current to flow only from shore ground to boat ground.

16. A galvanic isolator for protecting a submersible metal marine propulsion unit from corrosion, the galvanic isolator comprising:

a first SCR having an anode connected to a boat ground, a cathode connected to a shore ground, and a gate;

a first diode having an anode connected to said boat ground, and a cathode connected to said gate of said first SCR;

a second SCR having an anode connected to said shore ground, a cathode connected to said boat ground, and a gate;

a second diode having an anode connected to said shore ground, and a cathode connected to said gate of said second SCR.

17. The galvanic isolator of claim 16 comprising a first current limiting resistor connector in series with said first diode between said boat ground and said gate of said first SCR, and a second current limiting resistor connected in series with said second diode between said shore ground and said gate of said second SCR.

18. The galvanic isolator of claim 17 comprising a capacitor connected in parallel with each of said first and second SCRs between said boat ground and said shore ground.

19. A galvanic isolator for protecting a submersible metal marine propulsion unit from corrosion, the galvanic isolator comprising:

a first triac having a first main terminal connected to a boat ground, a second main terminal connected to a shore ground, and a gate;

a first diac having a first main terminal connected to said boat ground, and a second main terminal connected to said gate of said first triac;

a second triac having a first main terminal connected to said shore ground, a second main terminal connected to said boat ground, and a gate;

a second diac having a first main terminal connected to said shore ground, and a second main terminal connected to said gate of said second triac.

20. The galvanic isolator of claim 19 comprising a first current limiting resistor connected in series with said first diac between said boat ground and said gate of said first triac, and a second current limiting resistor connected in series with said second diac between said shore ground and said gate of said second triac.

21. The galvanic isolator of claim 20 comprising a capacitor connected in parallel with each of said first and second triacs between said boat ground and said shore ground.

* * * * *